US010352083B2

(12) United States Patent
Yu et al.

(10) Patent No.: US 10,352,083 B2
(45) Date of Patent: Jul. 16, 2019

(54) COMPARTMENT AND BOTTOM DOOR THEREOF

(71) Applicant: CRRC QIQIHAR Rolling Stock CO., LTD., Qiqihar, Heilongjiang (CN)

(72) Inventors: Lei Yu, Qiqihar (CN); Shengkun Wang, Qiqihar (CN); Yong Fu, Qiqihar (CN); Tianjun Zhao, Qiqihar (CN); Shuang Yang, Qiqihar (CN)

(73) Assignee: CRRC QIQIHAR ROLLING STOCK CO., LTD (CN)

( * ) Notice: Subject to any disclaimer, the term of this patent is extended or adjusted under 35 U.S.C. 154(b) by 283 days.

(21) Appl. No.: 15/317,670

(22) PCT Filed: May 8, 2015

(86) PCT No.: PCT/CN2015/078512
§ 371 (c)(1),
(2) Date: Dec. 9, 2016

(87) PCT Pub. No.: WO2016/074453
PCT Pub. Date: May 19, 2016

(65) Prior Publication Data

US 2017/0107751 A1 Apr. 20, 2017

(30) Foreign Application Priority Data

Nov. 14, 2014 (CN) ..... 2014 1 0649047

(51) Int. Cl.
*E06B 7/08* (2006.01)
*E05F 15/53* (2015.01)
(Continued)

(52) U.S. Cl.
CPC ..... *E05F 15/53* (2015.01); *B61D 7/02* (2013.01); *B61D 7/18* (2013.01); *B61D 7/28* (2013.01);
(Continued)

(58) Field of Classification Search
CPC ... B61D 7/18; B61D 7/00; B61D 7/26; B61D 7/28; B61D 7/02; E05F 15/53;
(Continued)

(56) References Cited

U.S. PATENT DOCUMENTS 3,949,681 A * 4/1976 Miller ..... B61D 7/18 105/284
4,222,334 A 9/1980 Peterson
(Continued)

FOREIGN PATENT DOCUMENTS

CA 2739319 A1 11/2012
CN 1272084 A 11/2000
(Continued)

OTHER PUBLICATIONS

International Search Report for PCT/CN2015/078512, dated Aug. 10, 2015, 5 pages.
(Continued)

*Primary Examiner* — Chi Q Nguyen
(74) *Attorney, Agent, or Firm* — Patterson Thuente Pedersen, P.A.

(57) ABSTRACT

A bottom door of a carriage includes a telescoping cylinder and at least two sets of door bodies, each set of the door body is provided with one set of driving mechanisms, each of the driving mechanisms includes a rotating shaft and a driving rod, and the rotating shaft is connected with the respective door body by the driving rod, to allow the door body to be driven to rotate when the rotating shaft rotates; each of the rotating shaft is driven to rotate by the telescoping cylinder, and at least two of the rotating shafts are configured to be driven to rotate successively by the telescoping cylinder.

12 Claims, 3 Drawing Sheets

(51) Int. Cl.
*B61D 7/02* (2006.01)
*B61D 7/18* (2006.01)
*B61D 7/28* (2006.01)

(52) U.S. Cl.
CPC ... *E05Y 2201/422* (2013.01); *E05Y 2201/454* (2013.01); *E05Y 2201/686* (2013.01); *E05Y 2201/706* (2013.01); *E05Y 2900/51* (2013.01); *E05Y 2900/53* (2013.01)

(58) Field of Classification Search
CPC ..... E05Y 2900/51; E05Y 2900/53; E05Y 2201/686; E05Y 2201/454; E05Y 2201/706; E05Y 2201/422; E05Y 2201/694
USPC ..... 49/74.1; 105/250, 251, 289, 299, 247
See application file for complete search history.

(56) References Cited

U.S. PATENT DOCUMENTS 4,766,820 A * 8/1988 Ritter ..... B61D 7/28 105/240
4,843,974 A * 7/1989 Ritter ..... B61D 7/28 105/240
5,115,748 A * 5/1992 Westlake ..... B61D 7/28 105/240
5,131,722 A * 7/1992 DeCap ..... B60P 1/56 222/502
5,261,333 A * 11/1993 Miller ..... B61D 7/28 105/240
5,579,593 A 12/1996 Murray
6,405,658 B1 * 6/2002 Taylor ..... B61D 7/18 105/284
8,596,203 B2 * 12/2013 Forbes ..... B61D 7/28 105/248
8,915,193 B2 * 12/2014 Bis ..... B61D 7/18 105/250
2010/0219148 A1 * 9/2010 Forbes ..... B61D 7/02 213/51
2010/0251923 A1 * 10/2010 Forbes ..... B61D 7/04 105/253
2012/0285346 A1 * 11/2012 Forbes ..... B61D 7/28 105/248
2014/0261068 A1 * 9/2014 Bis ..... B61D 7/18 105/251

FOREIGN PATENT DOCUMENTS

CN 101486347 A 7/2009
CN 201334017 Y 10/2009
CN 102556087 A 7/2012
CN 202508093 U 10/2012
CN 103158724 A 6/2013
CN 103223950 A 7/2013
CN 203805895 U 9/2014
CN 104442847 A 3/2015

OTHER PUBLICATIONS

English translation of International Search Report for PCT/CN2015/078512, dated Aug. 10, 2015, 3 pages.

* cited by examiner

COMPARTMENT AND BOTTOM DOOR THEREOF

This application is the national phase of International Application No. PCT/CN2015/078512, titled "COMPARTMENT AND BOTTOM DOOR THEREOF", filed on May 8, 2015, which claims the benefit of priority to Chinese patent application No. 201410649047.0 titled "CARRIAGE AND BOTTOM DOOR THEREOF", filed with the Chinese State Intellectual Property Office on Nov. 14, 2014, the entire disclosures of both applications are incorporated herein by reference.

FIELD

The present application relates to the technical field of the vehicle engineering, in particular to a bottom door of a carriage. Furthermore, the present application further relates to a carriage.

BACKGROUND

A carriage which can automatically discharge cargos is generally used in the railway transportation. A bottom of the carriage is provided with a bottom door, and cargos are discharged under the action of gravity after the bottom door is opened.

Reference is made to FIGS. 1 to 2. FIG. 1 is a schematic view showing the structure of a typical bottom door of a carriage, and FIG. 2 is a side view of the bottom door shown in FIG. 1.

The bottom door at a bottom of the carriage includes multiple sets of door bodies 1', and both the opening and closing of the multiple sets of the door bodies 1 are controlled by a driving mechanism. The driving mechanism includes an air cylinder 2', a main shaft 3' and a driving rod 4'. As shown in FIG. 1, the main shaft 3' is arranged in the length direction of the carriage, a telescoping end of the air cylinder 2' drives the main shaft 3' to rotate by a rocker arm 5', and multiple sets of driving rods 4' are distributed in the length direction of the main shaft 3'. Each set of driving rod 4' controls one set of door bodies 1', and the multiple sets of door bodies 1 can be controlled to be opened or closed at the same time by the main shaft 3' when the main shaft 3' rotates. As shown in FIG. 2, the driving mechanism is located at a bottom of the door body 1', the driving rod 4' includes a short rod 41' and connecting rods 42', the main shaft 3' is located at the middle of the short rod 41', two ends of the short rod 41' are respectively articulated to the connecting rods 42' and control the door body 1' by the connecting rods 42', and the connecting rods 42' are driven by the short rod 41' to swing to open or close the door body 1' when the short rod 41' rotates.

FIG. 2 shows the status of the driving rod 4' when the door bodies 1' are closed. A right end of the short rod 41' deflects upward and anticlockwise by 3 degrees to 4 degrees with respect to a horizontal position of the main shaft 3', and a moment generated by the deflection of the short rod 41' can act on the door bodies 1' to prevent the door bodies 1' from being opened.

During the extending process of the telescoping end of the air cylinder 2', the main shaft 3' rotates clockwise and drives the short rod 41'. During the process that the main shaft 3' rotates by 3 degrees to 4 degrees and drives the short rod 41' to rotate over the horizontal position, a dead point is passed and a resistance moment is overcame, and thus the door bodies are opened.

Before the door body 1' is opened, a moment, generated by the deflection of the short rod 41' to prevent the door body 1' from being opened, is a resistance moment when the door body 1' is opened. During the process of opening the door body 1', before the short rod 41' rotates to the horizontal position, the main shaft 3' requires the air cylinder 2' to provide an action force to overcome the resistance moment.

The air cylinder 2' is required to provide a large action force when one set of door body 1' is opened. In a case that the multiple sets of the door bodies 1' of the bottom door are opened at the same time, the main shaft 3' needs to overcome the resistance moments of the multiple sets of the door bodies 1' at the same time. Therefore, the air cylinder 2' is required to provide a very large action force, which is not easy to realize, and it is generally required to employ an air cylinder having a large diameter or multiple air cylinders to provide the action force. Moreover, because the action force is large and the impact force is also large during the opening process, the driving mechanism is apt to be broken and the reliability of the bottom door is affected.

Therefore, an urgent technical issue to be solved by the person skilled in the art is to decrease the required action force for opening the bottom door of the carriage.

SUMMARY

A bottom door of a carriage is provided according to the present application. A small action force is required for opening the bottom door, which improves the reliability of the bottom door. Furthermore, a carriage having the bottom door is also provided according to the present application.

The bottom door of the carriage provided according to the present application includes a telescoping cylinder and at least two sets of door bodies, wherein each set of the door body is provided with one set of driving mechanisms, each of the driving mechanisms includes a rotating shaft and a driving rod, and the rotating shaft is connected with the respective door body by the driving rod, to allow the door body to be driven to rotate when the rotating shaft rotates; each of the rotating shaft is driven to rotate by the telescoping cylinder, and at least two of the rotating shafts are configured to be driven to rotate successively by the telescoping cylinder.

Preferably, an end portion of the rotating shaft is provided with a rocker arm, one end of the rocker arm is fixed at the end portion of the rotating shaft and another end of the rocker arm is provided with a pin hole; in two adjacent rocker arms between the driving mechanisms, one of the two adjacent rocker arm is a pre-action rocker arm and the other one of the two adjacent rocker arm is a post-action rocker arm, and one of the two adjacent rocker arms has a round pin hole and the other one of the two adjacent rocker arm has an oblong pin hole, and the two adjacent rocker arms are connected by a pin shaft which is inserted into the round pin hole and the oblong pin hole; a telescoping end is connected to the pre-action rocker arm or the pin shaft; the driven pre-action rocker arm or the driven pin shaft drives a corresponding rotating shaft to rotate by a predetermined angle, and the pin shaft moves from one end to another end with respect to the oblong pin hole and abuts against an end portion of the oblong pin hole to drive an adjacent rotating shaft to rotate, to realize a successive rotation.

Preferably, the end portion of the rotating shaft is provided with a disc, in two adjacent discs between the driving mechanisms, one of the two adjacent discs has a protrusion and the other one of the two adjacent discs has an arc groove, and the protrusion is in cooperation with the arc groove; the telescoping end of the telescoping cylinder is connected with one of the two adjacent discs, and the driven disc drives a corresponding rotating shaft to rotate by a predetermined angle, and after the protrusion and the arc groove, in cooperation with each other, of the driven disc and the adjacent disc move by a predetermined distance relative to each other, the protrusion abuts against an end portion of the arc groove to drive an adjacent rotating shaft to rotate, to realize a successive rotation.

Preferably, the predetermined angle is greater than 3 degrees and less than 5 degrees.

Preferably, the telescoping end is connected with the pin shaft, the pre-action rocker arm has the round pin hole and the post-action rocker arm has the oblong pin hole.

Preferably, the bottom door includes two sets of door bodies, the driving mechanisms of the two sets of door bodies each includes one rocker arm, and two of the rocker arms are adjacent and connected by the pin shaft.

Preferably, the bottom door includes at least three sets of the door bodies, two ends of the rotating shaft of the driving mechanism located at an intermediate portion of the carriage both have the rocker arm; and the rotating shafts of the driving mechanisms located at two ends of the carriage each has one rocker arm which is located on the rotating shaft at an end adjacent to other driving mechanisms.

Preferably, the driving rod includes a short rod and connecting rods, the rotating shaft is located at a middle of the short rod and is configured to drive the short rod to rotate, and two ends of the short rod are respectively articulated to the connecting rods and are connected to the door body by the connecting rods.

Preferably, the telescoping cylinder is an air cylinder.

A carriage is also provided according to the present application, which includes a box body and a bottom door, the bottom door is arranged at a bottom of the box body and the bottom door is the bottom door according to any of the above solutions.

The bottom door of the carriage provided according to the present application includes a telescoping cylinder and at least two sets of door bodies, each set of door body is provided with one set of driving mechanism, each of the driving mechanism includes a rotating shaft and a driving rod, and the rotating shaft is connected with the door body by the driving rod, to allow the door body to be driven to rotate when the rotating shaft rotates; each rotating shaft is driven to rotate by the telescoping cylinder, and at least two rotating shafts can be driven to rotate successively by the telescoping cylinder.

Each set of door body of the bottom door is respectively controlled by the respective driving mechanism, and each rotating shaft can be driven to rotate successively by the telescoping cylinder. After one rotating shaft rotates, a corresponding door body is opened, and then the remaining rotating shafts can rotate successively, to open each set of door body corresponding to the rotating shafts successively in a certain order. When the telescoping cylinder drives one driving mechanism to act, the door body corresponding to this driving mechanism is opened, and after the door body overcomes the opening resistance and the driving mechanism does not require a thrust of the telescoping cylinder anymore, the next driving mechanism acts and the next set of door body is opened in a linked way. If there are multiple sets of door bodies, they can be successively opened according to this principle.

The bottom door employs the telescoping cylinder to open the multiples sets of door bodies successively. During the opening process, the telescoping cylinder only needs to provide an acting force required for opening one set of door body always. Compared with the conventional technology, the acting force required for opening the bottom door is small and the requirement for the acting force of the telescoping cylinder is decreased, thus it is easy to be realized, the volume of the telescoping cylinder is decreased, the space is saved and the dead weight is decreased. Furthermore, an impact force is also decreased during the opening process and the reliability of the whole bottom door is improved.

In an optional manner, an end portion of the rotating shaft is provided with a rocker arm, one end of the rocker arm is fixed at the end portion of the rotating shaft and another end of the rocker arm is provided with a pin hole. In two adjacent rocker arms between the driving mechanisms, one of the two adjacent rocker arm is a pre-action rocker arm and the other one is a post-action rocker arm, and one of the two adjacent rocker arms has a round pin hole and the other one has an oblong pin hole, and the two adjacent rocker arms are connected by a pin shaft inserted into the round pin hole and the oblong pin hole. A telescoping end is connected to the pre-action rocker arm or the pin shaft. The driven pre-action rocker arm or the driven pin shaft drives a corresponding rotating shaft to rotate by a predetermined angle, to move the pin shaft from one end to another end with respect to the oblong pin hole and abut against an end portion of the oblong pin hole to drive an adjacent rotating shaft to rotate, and thus a successive rotation is realized.

In another optional manner, the end portion of the rotating shaft is provided with a disc. In two adjacent discs between the driving mechanisms, one disc has a protrusion and the other one has an arc groove, and the protrusion is configured to cooperate with the arc groove. The telescoping end of the telescoping cylinder is connected with one disc and the driven disc drives a corresponding rotating shaft to rotate by a predetermined angle. After the protrusion and the arc groove of the driven disc and the adjacent disc moves by a predetermined distance with respect to each other, the protrusion abuts against an end portion of the arc groove to drive an adjacent rotating shaft to rotate, and thus realizing the successive rotation.

The carriage is further provided according to the present application, which includes the box body and the bottom door. The bottom door is arranged at the bottom of the box body and the bottom door is the above bottom door. Since the bottom door has the above technical effects, the carriage having the bottom door also has a corresponding technical effect.

Figure 1:
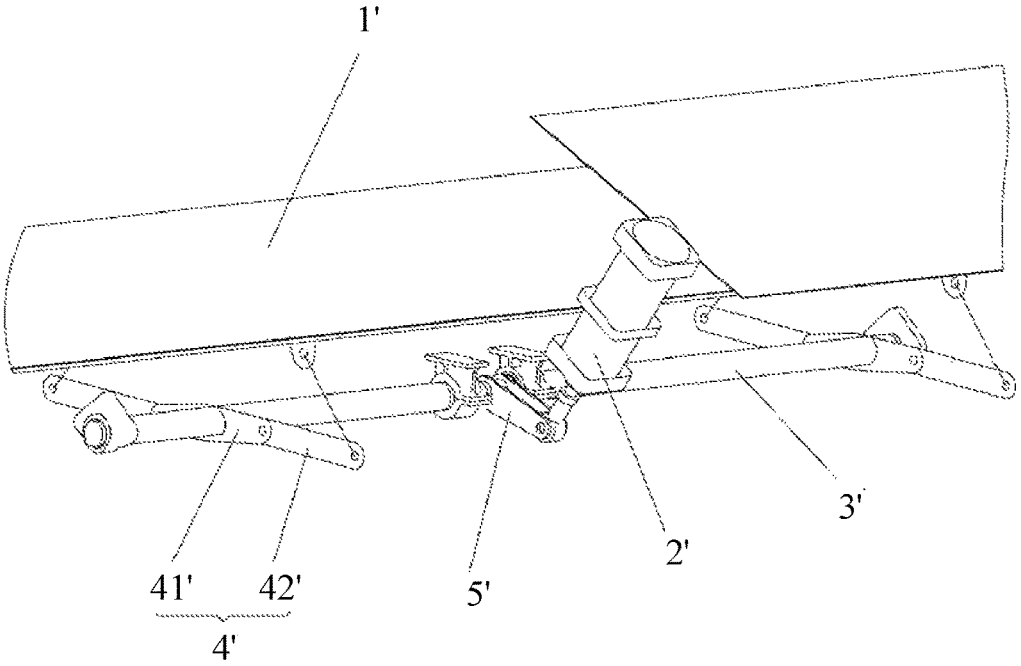
FIG. 1 is a schematic view showing the structure of a typical bottom door of a carriage.
Figure 2:
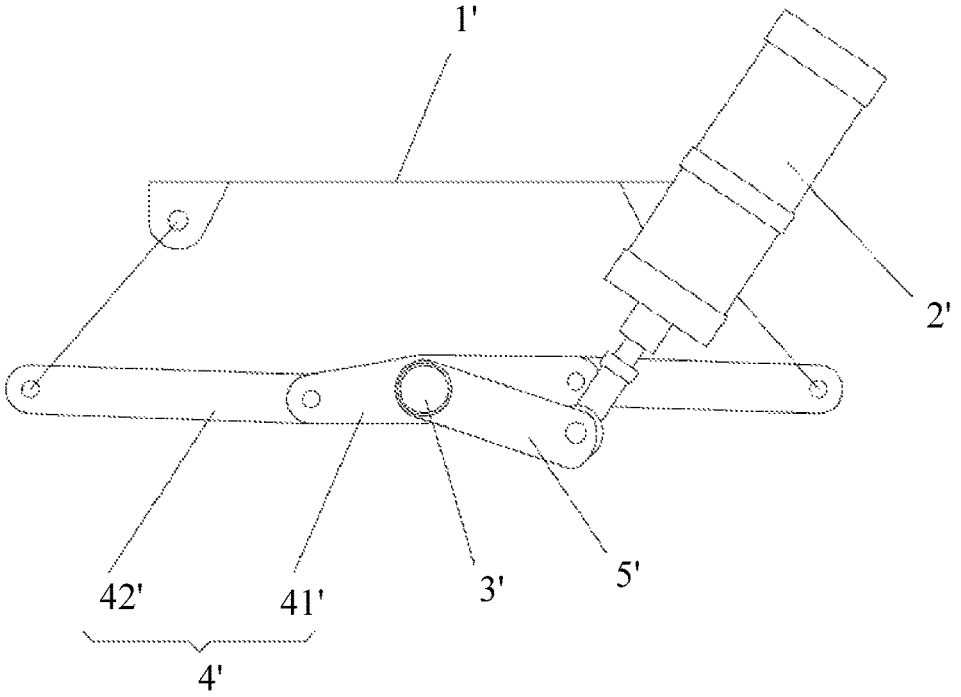
FIG. 2 is a side view of the bottom door shown in FIG. 1.

Corresponding relationships between the reference numerals in FIGS. 1 and 2 and the components:

| | | |
|---|---|---|
| door body 1', driving rod 4', rocker arm 5'. | air cylinder 2', short rod 41', | main shaft 3', connecting rod 42' |

Corresponding relationships between the reference numerals in FIGS. 3 to 6 and the components:

| | | |
|---|---|---|
| door body 1, driving rod 4, rocker arm 5, post-action rocker arm 53, | telescoping cylinder 2, short rod 41, pin hole 51, pin shaft 6. | rotating shaft 3, connecting rod 42, pre-action rocker arm 52, |

DETAILED DESCRIPTION

For the person skilled in the art to better understand the solutions of the present application, the present application is further described in detail in conjunction with drawings and embodiments.

Figure 3:
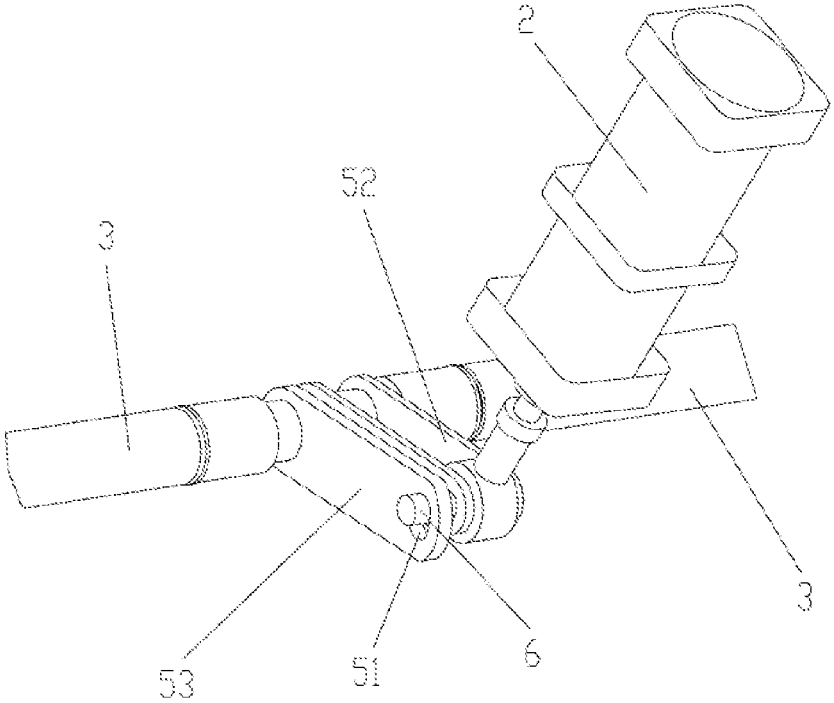
FIG. 3 is a schematic view showing a partial structure of a bottom door of a carriage according to the present application.
Figure 4:
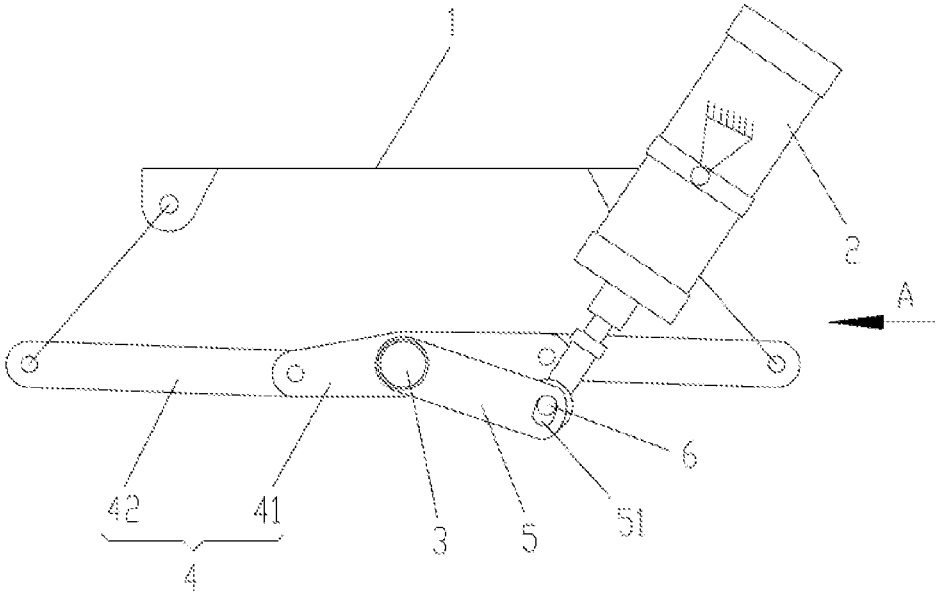
FIG. 4 is a side view of the bottom door shown in FIG. 3.
Figure 5:
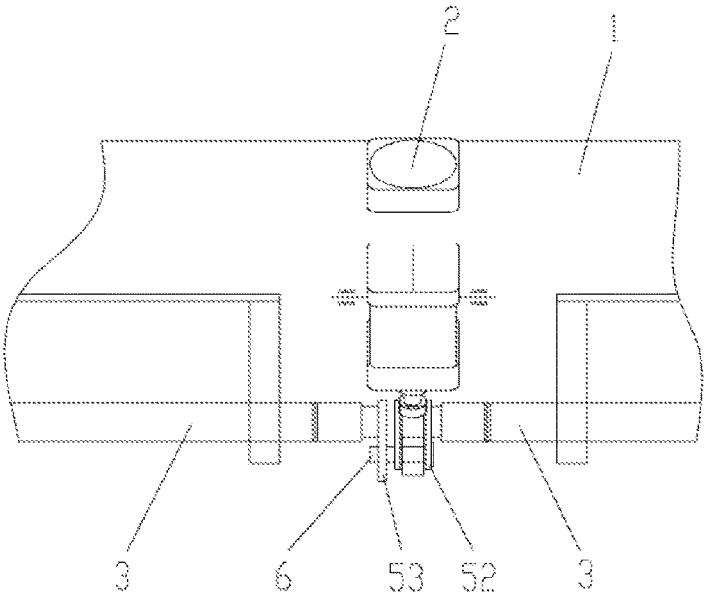
FIG. 5 is a schematic view of FIG. 4 viewed in direction A.

Reference is made to FIGS. 3 to 5. FIG. 3 is a schematic view showing a partial structure of a bottom door of a carriage according to the present application, FIG. 4 is a side view of the bottom door shown in FIG. 3, and FIG. 5 is a schematic view of FIG. 4 viewed in direction A, wherein, a door body is not showed in FIG. 3.

In a specific embodiment, a bottom door of a carriage is provided according to the present application, which includes a telescoping cylinder 2 and at least two sets of door bodies 1. Each set of door bodies 1 is provided with one set of a driving mechanism, the driving mechanism includes a rotating shaft 3 and a driving rod 4. The rotating shaft 3 is connected with the door body 1 by the driving rod 4, thus the door body 1 is driven to rotate when the rotating shaft 3 rotates. Each rotating shaft 3 is driven to rotate by the telescoping cylinder 2, and at least two rotating shafts 3 can be driven to rotate successively by the telescoping cylinder 2.

The multiple sets of the door bodies 1 of the bottom door are respectively controlled by respective driving mechanisms and are distributed in the length direction of the carriage, and the rotating shaft 3 of each driving mechanism is arranged in the length direction of the carriage and is located under a center line of each door body 1. The rotating shaft 3 of each set of driving mechanisms rotates to control the door body 1 to rotate through the driving rod 4, to realize the opening or closing of the door body 1. At the same time, a linkage can be formed between the driving mechanisms, and the opening and closing of the multiple sets of door bodies 1 can be controlled by one telescoping cylinder 2.

Each set of door body 1 of the bottom door is respectively controlled by the respective driving mechanism, and each rotating shaft 3 can be driven to rotate successively by the telescoping cylinder 2. After one rotating shaft 3 rotates, a corresponding door body 1 is opened, and then the remaining rotating shafts 3 can rotate successively, to open each set of door body 1 corresponding to the rotating shafts 3 successively in a certain order. When the telescoping cylinder 2 drives one driving mechanism to act, the door body 1 corresponding to this driving mechanism is opened, and after the door body 1 overcomes the opening resistance and the driving mechanism does not require a thrust of the telescoping cylinder 2 anymore, the next driving mechanism acts and the next set of door body 1 is opened in a linked way. If there are multiple sets of door bodies 1, they can be successively opened according to this principle.

The bottom door employs the telescoping cylinder 2 to open the multiples sets of door bodies 1 successively. During the opening process, the telescoping cylinder 2 only needs to provide an acting force required for opening one set of door body 1 always. Compared with the conventional technology, the acting force required for opening the bottom door is small and the requirement for the acting force of the telescoping cylinder 2 is decreased, thus it is easy to be realized, the volume of the telescoping cylinder 2 is decreased, the space is saved and the dead weight is decreased. Furthermore, an impact force is also decreased during the opening process and the reliability of the whole bottom door is improved.

In an optional structure, an end portion of the rotating shaft 3 is provided with a rocker arm 5, one end of the rocker arm 5 is fixed at the end portion of the rotating shaft 3 and another end of the rocker arm 5 is provided with a pin hole 51. In two adjacent rocker arms 5 between the driving mechanisms, one of the two adjacent rocker arm 5 is a pre-action rocker arm 52 and the other one is a post-action rocker arm 53, and one of the two adjacent rocker arms 5 has a round pin hole and the other one has an oblong pin hole, and the two adjacent rocker arms 5 are connected by a pin shaft 6 inserted into the round pin hole and the oblong pin hole. A telescoping end is connected to the pre-action rocker arm 52 or the pin shaft 6. The driven pre-action rocker arm 52 or the driven pin shaft 6 drives a corresponding rotating shaft 3 to rotate by a predetermined angle, to move the pin shaft 6 from one end to another end with respect to the oblong pin hole and abut against an end portion of the oblong pin hole to drive an adjacent rotating shaft 3 to rotate, and thus a successive rotation is realized.

The telescoping end of the telescoping cylinder 2 is connected with the pre-action rocker arm 52 or the pin shaft 6. As shown in FIG. 4, during the telescoping process of the telescoping end, the telescoping cylinder 2 also rotates accordingly. If the telescoping end is connected with the pre-action rocker arm 52, the pre-action rocker arm 52 swings. If the telescoping end is connected with the pin shaft 6, the pin shaft 6 drives the pre-action rocker arm 52 to swing. The two connecting manners can both make the pre-action rocker arm 52 to swing and at the same time drive the corresponding rotating shaft 3 to rotate, and thus driving the corresponding door body 1 to rotate. In FIGS. 3 and 5, the telescoping end of the telescoping cylinder 2 is connected with the pin shaft 6.

In the two rocker arms 5, connected by the pin shaft 6, of two adjacent driving mechanisms, one of the two adjacent rocker arms 5 is the pre-action rocker arm 52, and the other one is the post-action rocker arm 53 which can swing later. Similarly, multiple sets of driving mechanisms are successively connected by the rocker arms 5, each post-rocker arm 53 successively swings later, and each driving mechanism successively acts later, to allow the corresponding set of door body 1 to successively act.

It should be noted that, the pre-action rocker arm 52 is distinguished from the post-rocker arm 53 by an action order of the rocker arm 5. For the same rocker arm 5 in different connecting manners, it is defined as the pre-action rocker arm 52 if it acts first and it is defined as the post-rocker arm 53 if it acts later.

When the bottom door is opened, the rocker arms 5 of the driving mechanisms successively swing and the corresponding sets of door bodies 1 are successively opened. When the bottom door is closed, the telescoping end of the telescoping cylinder 2 pulls the pre-action rocker arm 52 or drives the pin shaft 6 to pull the pre-action rocker arm 52, and at the same time the linked post-action rocker arm 53 is driven to act, thereby closing the multiples sets of door bodies 1 at the same time.

When the telescoping cylinder 2 drives the pre-action rocker arm 52 to swing by a predetermined angle, the door body 1 corresponding to the pre-action rocker arm 52 is opened. After overcoming the opening resistance, the driving mechanism does not need the thrust of the telescoping cylinder 2 anymore and the linked post-action rocker arm 53 swings to open the next set of door body 1. If there are multiple sets of door bodies 1, they can be successively opened according to this principle. During the opening process, the telescoping cylinder 2 only needs to provide the acting force required for opening one set of door body 1 always.

In another optional structure, the end portion of the rotating shaft 3 is provided with a disc. In two adjacent discs between the driving mechanisms, one disc has a protrusion and the other one has an arc groove, and the protrusion is configured to cooperate with the arc groove. The telescoping end of the telescoping cylinder 2 is connected with one disc and the driven disc drives a corresponding rotating shaft 3 to rotate by a predetermined angle. After the protrusion and the arc groove of the driven disc and the adjacent disc moves by a predetermined distance with respect to each other, the protrusion abuts against an end portion of the arc groove to drive an adjacent rotating shaft 3 to rotate, and thus realizing the successive rotation.

The rotating shafts 3 of two adjacent driving mechanisms are connected by the discs at end portions thereof. In the two cooperating discs, one disc is provided with the protrusion and the other one is provided with the arc groove, and the protrusion is configured to cooperate with the arc groove. In a case that the rotating shaft 3 having the protrusion rotates, the protrusion moves in the arc groove, and when the protrusion moves to the end portion of the arc groove, the rotating shaft 3 having the arc groove is driven to rotate. This structure can realize a successive action of the two adjacent driving mechanisms. The telescoping end can be connected to the disc having the protrusion or also can be connected to the disc having the arc groove.

In the above embodiments, the predetermined angle is greater than 3 degrees and less than 5 degrees.

The rotating shaft 3 is connected to the door body 1 by the driving rod 4 to control the door body 1. When the door body 1 is closed, the driving rod 4 can generate a moment for preventing the door body 1 from being opened. When the door body 1 is opened, the rotating shaft 3 can rotate by 3 degrees to 4 degrees to pass a dead point, thereby overcoming a resistance moment, and if the rotating shaft 3 continues to rotate, the driving rod 4 can generate a moment for opening the door body 1.

Furthermore, in the trigonometric function, if an angle is less than 5 degrees, a sine value of the angle is approximately equal to an angle value, that is, $\sin \alpha = \alpha$, which means that a straight line can be approximately considered as an arc. For example, for the oblong pin hole at the end portion of the rocker arm 5 in the first optional structure, when the pre-action rocker arm 52 swings, an arc track of the pin shaft 6 can be approximately considered as a straight line movement in the oblong pin hole. Therefore, the predetermined angle ranges from 3 degrees to 5 degrees.

Of course, in a case that two long sides of the oblong pin hole are straight lines, the predetermined angle ranges from 3 degrees to 5 degrees. In a case that the two long sides of the oblong pin hole are arc lines, a maximum value of the predetermined angle can be equal to the value of a center angle that the arc line corresponds, for example, the arc groove in the second optional structure.

Furthermore, a specific range of the predetermined angle is defined according to a specific structure of the bottom door, and the range of the predetermined angle is not limited to the above ranges.

In the first optional structure, the telescoping cylinder 2 can be connected to the rocker arm 5 or also can be connected to the pin shaft 6. However, a structure that the telescoping cylinder 2 connected to the pin shaft 6 is preferable because this structure is easy to be realized, since it can be realized only by arranging a through hole at the telescoping end and inserting the pin shaft 6 in the through hole.

In a case that the telescoping end of the telescoping cylinder 2 is connected to the pin shaft 6, the rocker arm 5 having the round pin hole rotates first and the rocker arm 5 having the oblong pin hole rotates later, the pre-action rocker arm 52 is configured to have the round pin hole and the post-action rocker arm 53 is configured to have the oblong pin hole.

Figure 6:
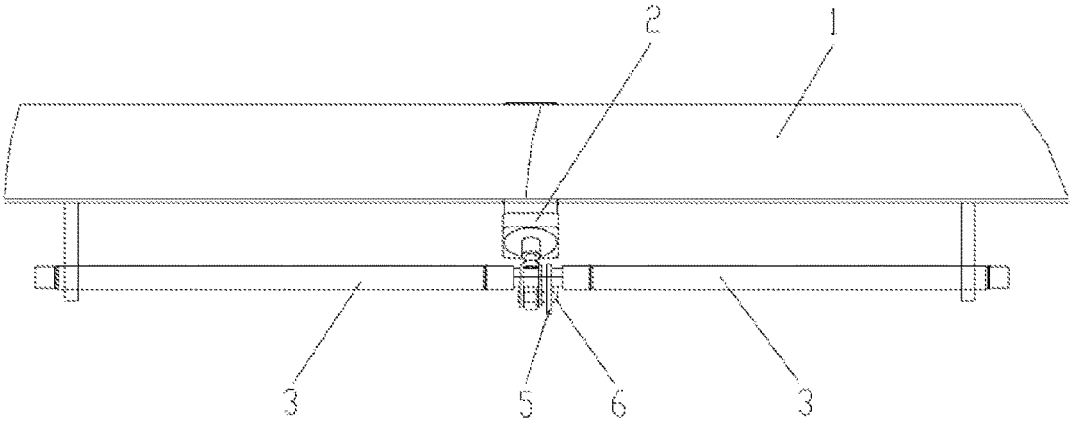
FIG. 6 is a schematic view showing the structure of the bottom door of the carriage according to an embodiment of the present application.

Reference is made to FIG. 6, which is a schematic view showing the structure of the bottom door of the carriage according to an embodiment of the present application.

The number of the door bodies 1 of the bottom door is generally determined according to the requirement of the length of the carriage. Specifically, in a case that the bottom door includes two sets of door bodies 1, the driving mechanism of each set of door body 1 includes one rocker arm 5 and two rocker arms 5 of the two sets of door bodies 1 are adjacent and connected by the pin shaft 6.

For the two rocker arms 5, one of the two rocker arms 5 is the pre-action rocker arm 52 having the round pin hole and the other one is the post-action rocker arm 53 having the oblong pin hole. The telescoping end of the telescoping cylinder 2 has the through hole and is sleeved on the pin shaft 6. When the telescoping end acts, the pre-action rocker arm 52 swings first, the post-action rocker arm 53 swings later, and the corresponding door bodies 1 are successively opened.

In another embodiment, in a case that the bottom door includes at least three sets of door bodies 1, two ends of the rotating shaft 3 of the driving mechanism located at an intermediate portion of the carriage are each provided with the rocker arm 5; and the rotating shaft 3 of each of the driving mechanisms located at two ends of the carriage is provided with one rocker arm 5 and the rocker arm 5 is located on the rotating shaft 3 at an end adjacent to other driving mechanisms.

Specifically, the telescoping end of the telescoping cylinder 2 can be connected to any pin shaft 6 or also can be connected to any pre-action rocker arm 52.

In the first embodiment, the telescoping end of the telescoping cylinder 2 is connected to the pre-action rocker arm 52 or the pin shaft 6 of the driving mechanism located at an end portion of the carriage. After the telescoping cylinder 2 drives the driving mechanism at the end portion of the carriage to act to open the door body 1, the driving mechanisms are successively driven to act from one end to another end of the carriage, and the door bodies 1 are successively opened. For the rocker arms 5 at two ends of the rotating shaft 3 of the driving mechanism located at the intermediate portion of the carriage, the rocker arm 5 at one end of the rotating shaft 3 is the pre-action rocker arm 52 and the rocker arm 5 at another end of the rotating shaft 3 is the post-action rocker arm 53, and the end of the rotating shaft 3 having the post-rocker arm 53 is close to the telescoping cylinder 2.

In the second embodiment, the telescoping end of the telescoping cylinder 2 is connected to the pre-action rocker arm 52 or the pin shaft 6 of the driving mechanism located at the intermediate portion of the carriage. After the telescoping cylinder 2 drives the driving mechanism connected to the telescoping cylinder 2 to open the door body 1, the driving mechanisms are successively driven to act from the driving mechanism at the intermediate portion of the carriage to the two ends of the carriage, and the multiple sets of door bodies 1 are successively opened.

If the driving mechanisms located at two ends of the driving mechanism connected to the telescoping cylinder 2 have the same number, two symmetric sets of door bodies 1 are opened at the same time after a first door body 1 is opened, and thus the opening time is shortened. Except for the driving mechanisms connected to the telescoping cylinder 2, in each of the rotating shafts 3 of other driving mechanisms, one end of the rotating shaft 3 having the post-action rocker arm 53 is close to the telescoping cylinder 2, and another end of the rotating shaft 3 having the pre-action rocker arm 52 drives the next driving mechanism which is located further outside.

In the above embodiments, as shown in FIG. 4, the driving rod 4 includes a short rod 41 and connecting rods 42, the rotating shaft 3 is located at the middle of the short rod 41 and can drive the short rod 41 to rotate, and two ends of the short rod 41 are respectively articulated to the connecting rods 42 and are connected to the door body 1 through the connecting rods 42.

FIG. 4 shows the status of the driving rod 4 when the door body 1 is closed. A right end of the short rod 41 deflects upward and anticlockwise by 3 degrees to 4 degrees with respect to a horizontal position of the rotating shaft 3, and a moment generated by the deflection of the short rod 41 acts on the door body 1 to prevent the door body 1 from being opened. In a case that the rotating shaft 3 rotates clockwise by 3 degrees to 4 degrees, the short rod 41 is driven to rotate to pass the horizontal position. After that, a moment, generated by the right end of the short rod 41 continuing to deflect downward and clockwise, is an opening moment of the door body 1.

Before the door body 1 is opened, a moment, generated by the deflection of the short rod 41 to prevent the door body 1 from being opened, is a resistance moment when opening the door body 1. During the process of opening the door body 1, after the short rod 41 rotates over the horizontal position and passes the dead point, the moment generated by the continual rotation of the short rod 41 is the opening moment of the door body 1.

The telescoping cylinder 2 in the above embodiments may be an air cylinder.

The bottom door uses one air cylinder to control the multiple sets of door bodies 1 to be successively opened and to be closed at the same time. At the same time, the requirement of an acting force of the air cylinder is reduced, and thus decreasing the diameter of the air cylinder, realizing the objects of saving space, decreasing the dead weight and improving the reliability.

In addition to the above bottom door, a carriage is further provided according to the present application, which includes a box body and a bottom door. The bottom door is arranged at a bottom of the box body and the bottom door is the above bottom door.

Since the bottom door has the above technical effects, the carriage having the bottom door also has a corresponding technical effect. Reference can be made to the conventional technology for the other structure of the carriage and the structure is not described herein.

The carriage and the bottom door thereof provided according to the present application have been described in detail hereinbefore. The principle and embodiments of the present application are explained by specific examples and the descriptions of the above embodiments are merely used to facilitate understanding the method and core concept of the present application. It should be noted that, for the person skilled in the art, many improvements and modifications may be made to the present application without departing from the principle of the present application, and these improvements and modifications are also deemed to fall into the scope of the present application defined by the claims.

The invention claimed is:

1. A bottom door of a carriage, comprising a telescoping cylinder and at least two sets of door bodies, wherein each set of the door body is provided with one set of driving mechanisms, each of the driving mechanisms comprises a rotating shaft and a driving rod, and the rotating shaft is connected with the respective door body by the driving rod, to allow the door body to be driven to rotate when the rotating shaft rotates; each of the rotating shaft is driven to rotate by the telescoping cylinder, and at least two of the rotating shafts are configured to be driven to rotate successively by the telescoping cylinder; and wherein an end portion of the rotating shaft is provided with a rocker arm, one end of the rocker arm is fixed at the end portion of the rotating shaft and another end of the rocker arm is provided with a pin hole; in two adjacent rocker arms between the driving mechanisms, one of the two adjacent rocker arm is a pre-action rocker arm and other one of the two adjacent rocker arm is a post-action rocker arm, and one of the two adjacent rocker arms has a round pin hole and other one of the two adjacent rocker arm has an oblong pin hole, and the two adjacent rocker arms are connected by a pin shaft which is inserted into the round pin hole and the oblong pin hole; a telescoping end is connected to the pre-action rocker arm or the pin shaft; a driven pre-action rocker arm or a driven pin shaft drives a corresponding rotating shaft to rotate by a predetermined angle, and the pin shaft moves from one end to another end with respect to the oblong pin hole and abuts against an end portion of the oblong pin hole to drive an adjacent rotating shaft to rotate, to realize a successive rotation.

2. The bottom door of the carriage according to claim 1, wherein the predetermined angle is greater than 3 degrees and less than 5 degrees.

3. The bottom door of the carriage according to claim 1, wherein the telescoping end is connected with the pin shaft, the pre-action rocker arm has the round pin hole and the post-action rocker arm has the oblong pin hole.

4. The bottom door of the carriage according to claim 3, wherein the bottom door comprises two sets of door bodies, the driving mechanisms of the two sets of door bodies each comprises one rocker arm, and two of the rocker arms are adjacent and connected by the pin shaft.

5. The bottom door of the carriage according to claim 4, wherein the driving rod comprises a short rod and a connecting rod, the rotating shaft is located at a middle of the short rod and is configured to drive the short rod to rotate, and two ends of the short rod are respectively articulated to the connecting rod and are connected to the door body by the connecting rod.

6. The bottom door of the carriage according to claim 3, wherein the bottom door comprises at least three sets of door bodies, two ends of the rotating shaft of the driving mechanism located at an intermediate portion of the carriage both have the rocker arm; and the rotating shafts of the driving mechanisms located at two ends of the carriage each has one rocker arm which is located on the rotating shaft at an end adjacent to other driving mechanisms.

7. The bottom door of the carriage according to claim 6, wherein the driving rod comprises a short rod and a connecting rod, the rotating shaft is located at a middle of the short rod and is configured to drive the short rod to rotate, and two ends of the short rod are respectively articulated to the connecting rod and are connected to the door body by the connecting rod.

8. The bottom door of the carriage according to claim 3, wherein the driving rod comprises a short rod and a connecting rod, the rotating shaft is located at a middle of the short rod and is configured to drive the short rod to rotate, and two ends of the short rod are respectively articulated to the connecting rod and are connected to the door body by the connecting rod.

9. The bottom door of the carriage according to claim 8, wherein the telescoping cylinder is an air cylinder.

10. The bottom door of the carriage according to claim 1, wherein the driving rod comprises a short rod and a connecting rod, the rotating shaft is located at a middle of the short rod and is configured to drive the short rod to rotate, and two ends of the short rod are respectively articulated to the connecting rod and are connected to the door body by the connecting rod.

11. The bottom door of the carriage according to claim 10, wherein the telescoping cylinder is an air cylinder.

12. A carriage, comprising a box body and a bottom door, and the bottom door being arranged at a bottom of the box body, wherein the bottom door is the bottom door according to claim 1.

* * * * *